US005238768A

United States Patent [19]

Ong

[11] Patent Number: 5,238,768

[45] Date of Patent: Aug. 24, 1993

[54] TONER COMPOSITIONS WITH SULFONE CHARGE ENHANCING ADDITIVES

[75] Inventor: Beng S. Ong, Mississauga, Canada

[73] Assignee: Xerox Corporation, Stamford, Conn.

[21] Appl. No.: 898,610

[22] Filed: Jun. 15, 1992

[51] Int. Cl.[5] ..... G03G 9/097

[52] U.S. Cl. ..... 430/110; 430/137

[58] Field of Search ..... 430/110, 137

[56] References Cited

U.S. PATENT DOCUMENTS 4,206,064 6/1980 Kiuchi et al. ..... 430/106
4,411,974 10/1983 Lu et al. ..... 430/106
4,845,003 7/1989 Kiriu et al. ..... 430/110
5,171,654 12/1992 Yamazaki et al. ..... 430/110

*Primary Examiner*—John Goodrow
*Attorney, Agent, or Firm*—E. O. Palazzo

[57] ABSTRACT

A negatively charged toner composition comprised of resin particles, colorants, optional surface additives, and a dihydroxyaryl sulfone charge enhancing additive, or an unsymmetrical hydroxyaryl sulfone charge enhancing additive obtained from the condensation of sulfuric acid with a molar equivalent of a phenol, followed by condensation with a second phenol, or from the condensation of an aromatic sulfonic acid with a phenol.

25 Claims, No Drawings

TONER COMPOSITIONS WITH SULFONE CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In one embodiment, there are provided in accordance with the present invention toner compositions comprised of a polymer or polymer resins, pigment particles or dye molecules, and certain aryl sulfone charge enhancing additives. In another embodiment, the present invention is directed to toners with hydroxyaryl sulfones, particularly unsymmetrical hydroxyaryl sulfone charge enhancing additives, which additives can be obtained from the reaction of a phenol with one molar equivalent of sulfuric acid, followed by condensation of the resulting hydroxyaryl sulfonic acid with another phenol. In a further embodiment, the present invention relates to the provision of toners with bis(dihydroxyaryl) sulfone charge enhancing additives, which additives are synthesized from the condensation of sulfuric acid with two molar equivalents of a hydroxyphenol. The aforementioned charge additives in embodiments of the present invention enable, for example, toners with rapid triboelectric charging characteristics, extended developer life, stable triboelectrical properties irrespective of changes in environmental conditions, and high image print quality with substantially no background deposits. Also, the aforementioned toner compositions usually contain a colorant or colorants comprised of, for example, carbon black, magnetites, or mixtures thereof, color pigments or dyes of cyan, magenta, yellow, blue, green, red, or brown color, or mixtures thereof thereby providing for the development and generation of black and/or colored images. The toner and developer compositions of the present invention can be selected for electrophotographic, especially xerographic, imaging and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003 there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not as efficient as desired in promoting the rate of triboelectric charging of the toner particles. A fast rate of triboelectric charging is particularly crucial for high speed xerographic machines since, for example, these machines consume toner rapidly, and fresh toner has to be constantly added. The added uncharged toners therefore must charge up to their equilibrium triboelectric charge level rapidly to ensure no interruption in the xerographic imaging or printing operation. Another shortcoming of these charge additives is their thermal instability, that is they often break down during the thermal extrusion process of the toner manufacturing cycle. Additionally, the hydroxybenzoic acid ligands, particularly 3,5-di-tert-butylsalicylic acid, are expensive precursors for these additives. Furthermore, many of these charge additives contain metals, and when utilized in higher concentrations, they may not meet environmental safety legislation requirements. Most or many of these and other disadvantages are eliminated, or substantially eliminated with the metal complex charge additives of the present invention.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure, and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, illustrates developer compositions containing as charge enhancing additives organic sulfate and sulfonates, which additives can impart a positive charge to the toner composition; U.S. Pat. No. 4,298,672, the disclosure of which is totally incorporated herein by reference, illustrates positively charged toner compositions with resins and pigment particles, and as charge enhancing additives alkyl pyridinium compounds.

Although many charge enhancing additives are known, there continues to be a need for charge enhancing additives which when incorporated in toners, provide many of the advantages illustrated herein. There is also a need for negative charge enhancing additives which are useful for incorporation into black and colored toner compositions which can be utilized for developing positive electrostatic latent images. Moreover, there is a need for toner compositions utilizing charge enhancing additives which do not contain heavy metals. Furthermore, there is a need for colored toner compositions containing substantially nontoxic charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can therefore form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of preferably from between about −10 to about −40 microcoulombs per gram, and triboelectric charging rates of less than about 5 minutes, and preferably less than 2 minutes as measured by standard charge spectrograph methods when the toners are frictionally charged against suitable carrier particles via conventional roll milling techniques. There is also a need for nontoxic, substantially nontoxic, or environmentally compatible charge enhancing additives which when incorporated at effective concentrations of, for example, less than 10 weight percent, preferably less than 5 weight percent in toners, render such toners environmentally acceptable. An additional need resides in the provision of simple and cost-effective preparative processes for the preparation of sulfone charge enhancing additives. The concentrations of the charge additives that can be incorporated into the toner compositions generally ranges from about 0.05 weight percent to about 5 weight percent, depending on whether the charge additive is utilized as a surface additive or as a dispersion in the bulk of the toner. The effective concentrations of toner in the developer, that is toner and carrier particles, are for example from about 0.5 to about 5 weight percent, and preferably from about 1 to about 3 weight percent.

Illustrated in copending patent applications U.S. Ser. No. 894,688 (and U.S. Ser. No. 894,690 ( are toner compositions with metal charge enhancing additives, and more specifically, a negatively charged toner composition comprised of a polymer or polymer resins, a colorant or colorants, optional surface additives, and a metal complex charge enhancing additive obtained from the reaction of a hydroxybenzoic acid and a base with a mixture of a metal ion and a hydroxyphenol; and a negatively charged toner composition comprised of a polymer or polymers, a colorant or colorants, optional surface additives, and a metal complex charge enhancing additive obtained from the reaction of a hydroxybenzoic acid and a base with a mixture of a metal ion and an aromatic dicarboxylic acid.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

In yet a further object of the present invention there may be provided, it is believed, humidity insensitive, from about, for example, 20 to 80 percent relative humidity at temperatures of from 60° to 80° F. as determined in a relative humidity testing chamber, negatively charged toner compositions with desirable triboelectric charging rates of less than 5 minutes, and preferably less than 2 minutes as determined by the charge spectrograph method as described hereinbefore, and acceptable triboelectric charging levels of from about −10 to about −40 microcoulombs per gram.

An additional object of the present invention is to provide toner and developer compositions incorporating environmental friendly metal-free charge enhancing additives.

Another object of the present invention resides in the preparation of negatively charged toners which will enable the development of images in electrophotographic imaging apparatuses, and which images have substantially no background deposits thereon, are substantially smudge proof or smudge resistant, and therefore are of excellent resolution; and further, such toner compositions can be selected for high speed electrophotographic apparatuses, that is for example those exceeding 50 copies per minute.

A further object of the present invention is to provide substantially nontoxic charge additives for toners with a low degree of structural symmetry.

A still further object is to provide simple and cost-effective processes for the preparation of certain sulfone charge enhancing additives.

These and other objects of the present invention may be accomplished in embodiments thereof by providing toner compositions comprised of a polymer resin or polymer resins, a colorant or colorants comprised of color pigment particles or dye molecules, and certain hydroxyaryl sulfone charge additives. More specifically, the present invention in embodiments is directed to toner compositions comprised of polymer resins or toner resin particles, pigment, or dye, and a hydroxyaryl sulfone negative charge enhancing additive of the formula

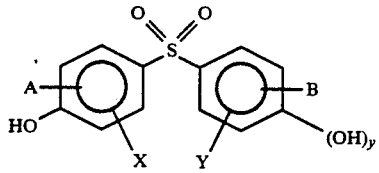

wherein A and B are substituents independently selected, for example, from the group consisting of hydrogen atom, an alkyl group, alkoxy group, carboxy group, nitro group, halogen atom, and the like; X and Y are substituents independently selected, for example, from the group consisting of hydrogen atom, hydroxy, alkyl group, alkoxy group, carboxy group, nitro group, halogen atom, and the like; and y is the number 0 or 1. Except primarily for bis(dihydroxyaryl) sulfones, the sulfone charge enhancing additives are unsymmetrical in structure in that they possess two different aryl groups. Examples of alkyl and alkoxy include those with 1 to about 20 carbon atoms, such as methyl, methoxy, ethyl, ethoxy, propyl, propoxy, butyl, butoxy, pentyl, pentoxy, hexyl, hexoxy, heptyl, heptoxy, octyl, octyoxy, nonyl, nonoxy, heptyl, heptoxy, octadecyl, octaoxy, stearyl, stearyloxy, and the like. Halogen atom includes chlorine, bromine, iodine, and fluorine, with chlorine and bromine being preferred.

Illustrative examples of sulfone charge enhancing additives that can be selected for the toner and developer compositions of the present invention include, for example, phenyl-4-hydroxyphenyl sulfone, tolyl 4-hydroxyphenyl sulfone, phenyl 4-hydroxy-3-tolyl sulfone, 4-hydroxyphenyl-4-hydroxy-3-tolyl sulfone, 4-hydroxyphenyl-3,4-hydroxyphenyl sulfone, 4-hydroxy-3-tolyl-4-hydroxy-3,5-dimethylphenyl sulfone, 4-hydroxy-3-tolyl-4-hydroxy-3,5-dimethylphenyl sulfone, 4-hydroxy-3,5-dimethylphenyl-2-methyl-4,5-dihydroxyphenyl sulfone, 3,4-dihydroxyphenyl-4-hydroxy-3,5-dimethylphenyl sulfone, bis(3,4-dihydroxyphenyl) sulfone, bromophenyl-4-hydroxyphenyl sulfone, chlorophenyl-4-hydroxyphenyl sulfone, 4-hydroxyphenyl-4,5-dihydroxy-2-tolyl sulfone, and the like.

The aforementioned charge enhancing additives can be incorporated into the toner, may be present on the toner surface, or may be present on toner surface additives such as colloidal silica particles. Advantages of rapid triboelectric charging characteristics of generally less than 120 seconds, and preferably less than 60 seconds in embodiments as measured by the standard charge spectrograph methods when the toners are frictionally charged against carrier particles by known conventional roll mixing methods, appropriate triboelectric charge levels as measured by the known Faraday Cage method, and the like, can be achieved with many of the aforementioned toners of the present invention. In another embodiment of the present invention, there are provided, subsequent to known micronization and classification, toner particles with a volume average diameter of from about 5 to about 20 microns.

The sulfone charge enhancing additives of the present invention can be prepared by the condensation of an aromatic compound like a phenol with one molar equivalent of sulfuric acid followed by condensation with a second phenol. The aryl hydroxyaryl sulfone charge additives can be obtained by the condensation of an aromatic sulfonic acid such as benzene sulfonic acid, toluene sulfonic acid, and the like with a phenol. In general, the first condensation was executed at a temperature ranging from 75° C. to about 135° C. while the second condensation was accomplished at a temperature ranging from 120° C. to about 200° C.

The toner compositions of the present invention can be prepared by a number of known methods such as admixing and heating polymer resins such as styrene butadiene copolymers, colorants such as pigment particles or dye compounds, and the aforementioned sulfone charge enhancing additive, or mixtures of charge enhancing additives in a concentration preferably ranging from about 0.5 percent to about 5 percent, in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 5 to about 25 microns, and preferably from about 5 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; polyurethanes; polyamides and polyimides; polyesters; and the like. The polymer resins selected for the toner compositions of the present invention include homopolymers or copolymers of two or more monomers. Furthermore, the above mentioned polymer resins may also be crosslinked depending on the toner properties desired. Illustrative vinyl monomer segments in the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. No. 07/814,641, and U.S. Ser. No. 07/814,782, the disclosures of which are totally incorporated herein by reference, can be selected as toner resins. Specific toner resins include styrene-methacrylate copolymers, and styrene-butadiene copolymers; PLIOLITES ®; and suspension polymerized styrene-butadienes, reference U.S. Pat. No. 4,558,108, the disclosure of which is totally incorporated herein by reference. Also, waxes with a molecular weight of from about 1,000 to about 6,000 such as polyethylene, polypropylene, and paraffin waxes can be included in, or on the toner compositions as fuser roll release agents.

The toner resins are present in a sufficient, but effective amount, for example from about 30 to about 95 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent.

Numerous well known suitable pigments or dyes can be selected as the colorant for the toner compositions including, for example, carbon black, like REGAL 330 ®, nigrosine dye, metal phthalocyanines, aniline blue, magnetite, or mixtures thereof. The colorant, which is preferably carbon black or other color pigments, should be present in a sufficient amount to provide a toner composition with a high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK ®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK ®, in an amount of, for example, from about 5 to about 70, and preferably from about 10 to about 50 weight percent can be selected for the black toner compositions of the present invention.

There can also be blended with the toner compositions of the present invention external additives including flow aid additives, which additives are usually present on the surface thereof. Examples of these additives include colloidal silicas such as AEROSIL ®, metal salts and metal salts of fatty acids inclusive of zinc stearate, aluminum oxides, cerium oxides, titanium oxides, and mixtures thereos, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSIL ® can be surface treated by the mixing thereof with the sulfone charge additives of the present invention illustrated herein in an amount of from about 1 to about 50 weight percent and preferably 10 weight percent to about 30 weight percent, followed by the addition thereof to the toners in an amount of from 0.1 to 10 and preferably 0.1 to 5 weight percent.

There can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, optional carrier particles, the charge enhancing additives illustrated herein, and as colorants red, blue, green, brown, magenta, cyan, yellow as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In embodiments, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, carrier particles can be selected that would render the toner particles negatively charged via frictional charging against the toner particles of the present invention. The opposite charge polarities of the carrier and toner particles of the developer composition thus ensure that the toner particles will adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat.

Nos. 4,937,166 and 4,935,326, the disclosures of which are totally incorporated herein by reference, including for example KYNAR ® and polymethyl methacrylate mixtures (40/60). Coating weights can vary as indicated herein; generally, however, from about 0.3 to about 2, and preferably from about 0.5 to about 1.5 weight percent coating is selected.

Furthermore, the diameter of the carrier particles, preferably spherical in shape, is generally from about 50 microns to about 1,000, and preferably from between about 80 and 200 microns in volume average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toner composition of the present invention can be prepared by a number of known methods including extrusion melt blending the toner resins, colorants, and the metal complex charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the addition of the charge enhancing additive-treated surface additives such as colloidal silicas. Further, other methods of preparation for the toner are as illustrated herein.

The toner and developer compositions of the present invention may be selected for use in electrostatographic imaging apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 5 to about 25 microns, and more preferably from about 5 to about 12 microns. The triboelectric charging rates for the toners of the present invention are preferably less than 5 minutes, and more specifically, less than 2 minutes in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

In embodiments, the present invention is directed to a negatively charged toner composition comprised of resin particles, colorants, optional surface additives, and a dihydroxyaryl sulfone charge enhancing additive, or an unsymmetrical hydroxyaryl sulfone charge enhancing additive obtained from the condensation of sulfuric acid with a molar equivalent of a phenol, followed by condensation with a second phenol, or from the condensation of an aromatic sulfonic acid with a phenol; and a process for the preparation of hydroxyaryl sulfone charge enhancing additives by the condensation of sulfuric acid with a hydroxyphenol by the condensation of sulfuric acid with a phenol, followed by condensation with a second phenol, or by the condensation of an aromatic sulfonic acid with a phenol.

The following Examples are being submitted to illustrate embodiments of the present invention. These Examples are intended to be illustrative only and are not intended to limit the scope of the present invention. Also, parts and percentages are by weight unless otherwise indicated.

EXAMPLE I

In a 500 milliliter 3-neck round-bottomed flask fitted with a thermometer, a mechanical stirrer, and a Dean Stark trap with a water condensor were added 10.32 grams (0.10 mole) of 95 percent sulfuric acid, 100 milliliters of n-heptane solvent, and 12.22 grams (0.10 mole) of 2,6-dimethylphenol. The mixture was mechanically stirred and heated to reflux, while distilling off the condensation byproduct water azeotropically over a period of 3 hours. Subsequently, 10.81 grams (0.10 mole) of ortho-cresol and 50 milliliters of ISOPAR G TM were added, and the resulting mixture was again heated to reflux with the azeotropical removal of water being accomplished over a period of 10 hours. After the reaction, the solvent was decanted off, and the solid residue was dissolved in methanol, treated with Norit, and filtered. The sulfone product was precipitated from the filtrate by adding water. Recrystallization from methanol and water afforded 19.6 grams of 4-hydroxy-3-tolyl-4-hydroxy-3,5-dimethylphenyl sulfone. Mass spectrum showed a molecular ion at m/e, 292.

EXAMPLE II 4-hydroxyphenyl-4-hydroxy-3,5-dimethylphenyl sulfone charge enhancing additive was prepared in accordance with the procedure of Example I except that phenol was utilized in place of ortho-cresol. The yield was 61 percent, and the sulfone product showed a molecular ion at m/e, 278.

EXAMPLE III 3,4-dihydroxyphenyl-4-hydroxy-3,5-dimethylphenyl sulfone charge enhancing additive was prepared in accordance with the procedure of Example I except that catechol was utilized in place of ortho-cresol. The yield was 64 percent, and the sulfone product showed a molecular ion at m/e, 294.

EXAMPLE IV 4,5-dihydroxy-2-tolyl-4-hydroxy-3,5-dimethylphenyl sulfone charge enhancing additive was prepared in accordance with the procedure of Example I except that 4-methyl-catechol was utilized in place of ortho-cresol. The yield was 64 percent, and the sulfone product showed a molecular ion at m/e, 308.

EXAMPLE V

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference; and 6.0 weight percent of REGAL 330 ® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface coated with 1.0 weight percent of the sulfone charge enhancing additive of Example I by conventional dry blending for 30 to 60 seconds.

The above treated toner was equilibrated at room temperature under 50 percent relative humidity for 24 hours. A developer was then prepared by blending 2.0 weight percent of the surface treated toner with 98.0 weight percent of a carrier containing a nickel zinc ferrite core and 0.9 weight percent of a polymer composite coating comprised of 80 weight percent of a methyl terpolymer and 20 weight percent of VULCAN XC72R TM carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −11.3 microcoulombs per gram by the standard blow-off technique in a Faraday Cage apparatus. To measure the rate of triboelectric charging of toner, 1.0 weight percent of the above uncharged toner was added to the time zero developer, and the charge distribution of the toner of the resulting developer was measured using a charge spectrograph as a function of the blending time via roll milling. The time required for the toner of the resulting developer to attain a charge distribution similar to that of the toner of the time zero developer was taken to be the rate of charging of the toner. For this toner, the rate of charging was about 1 minute.

COMPARATIVE EXAMPLE

A comparative black toner with a commercial aluminum complex charge enhancing additive, BONTRON E-88 TM, reference U.S. Pat. No. 4,845,003, which E-88 TM was obtained from Orient Chemicals, was prepared by blending the untreated toner of Example V with 1.0 weight percent of BONTRON E-88 TM, and a developer was then prepared from this toner in accordance with the procedure of Example V. The toner exhibited a triboelectric charge of −15.2 microcoulombs per gram, and its rate of charging was measured to be about 3 minutes.

EXAMPLE VI

A black toner was prepared utilizing the sulfone charge enhancing additive of Example II instead of the sulfone additive of Example I, and a developer was subsequently prepared from this toner in accordance with the procedure of Example V. The toner had a triboelectric charge of −11.8 microcoulombs per gram, and a rate of charging of about 1 minute.

EXAMPLE VII

A black toner was prepared utilizing the sulfone charge enhancing additive of Example III instead of the sulfone additive of Example I, and a developer was subsequently prepared from this toner in accordance with the procedure of Example V. The toner displayed a triboelectric charge of −14.6 microcoulombs per gram, and its rate of charging was measured to be about 30 seconds.

EXAMPLE VIII

A blue toner comprised of 90.0 weight percent of SPAR II TM polyester resin, 2.0 weight percent of PV FAST BLUE TM pigment, and 8.0 weight percent of the sulfone charge enhancing additive of Example IV was prepared by melt blending these three components, followed by micronizing and classifying in accordance with the procedure of Example V. The resulting toner has a volume average particle diameter of 9.6 microns, and a particle size distribution of 1.24. A developer was prepared from this toner using 2.0 weight percent of toner and a carrier containing a steel core and 0.8 weight percent of a polymer composite coating comprised of 80 weight percent of polymethyl methacrylate and 20 weight percent of VULCAN XC72R TM carbon black. The toner displayed a triboelectric charge of −10.4 microcoulombs per gram, and its rate of charging was measured to be about 60 seconds.

The toner was then surface coated with 0.4 weight percent of AEROSIL R972 ® by a conventional dry blending method, and a developer was prepared from this toner and the same carrier particles as illustrated herein. The triboelectric charge of the toner was measured to be −13.2 microcoulombs per gram, and its rate of charging was 60 seconds.

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of resin particles, colorants, optional surface additives, and a dihydroxyaryl sulfone charge enhancing additive, or an unsymmetrical hydroxyaryl sulfone charge enhancing additive obtained from the condensation of sulfuric acid with a molar equivalent of a phenol, followed by condensation with a second phenol, or from the condensation of an aromatic sulfonic acid with a phenol.

2. A negatively charged toner composition comprised of polymer, colorant, optional surface additives, and a sulfone charge enhancing additive of the following formula

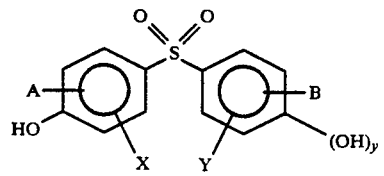

where A and B are substituents independently selected from the group consisting of hydrogen, alkyl, alkoxy, carboxy, nitro, and halogen; X and Y are substituents independently selected from the group consisting of hydrogen, hydroxy, alkyl, alkoxy, carboxy, nitro, and halogen; and y is the number 0 or 1.

3. A toner composition in accordance with claim 2 wherein the substituents A, B, X and Y are hydrogen atoms, halogen atoms or alkyl groups containing from 1 to about 10 carbon atoms; and y is 0.

4. A toner composition in accordance with claim 2 wherein the substituents A, B, and Y are hydrogen atoms, halogen atoms or alkyl groups containing from 1 to about 10 carbon atoms; the substituent X is a hydroxy group; and y is 0.

5. A toner composition in accordance with claim 2 wherein the substituents A and B are comprised of dissimilar halogen atoms, dissimilar alkyl groups containing from 1 to about 10 carbon atoms; the substituents X and Y are hydrogen atoms, halogen atoms or alkyl groups containing from 1 to about 10 carbon atoms; and y is 1.

6. A toner composition in accordance with claim 2 wherein the substituents A and B are hydrogen atoms, halogen atoms, or alkyl groups containing from 1 to about 10 carbon atoms; and the substituents X and Y are hydroxy groups.

7. A toner composition in accordance with claim 2 wherein at least one of the substituents A, B, X and Y is a nitro group or carboxy group.

8. A toner composition in accordance with claim 1 wherein the charge additive is present in an amount of from about 0.05 to about 5 weight percent.

9. A toner composition in accordance with claim 1 wherein the charge additive is incorporated into the toner, or present on the surface of the toner composition.

10. A toner composition in accordance with claim 9 wherein the charge additive is contained on colloidal silica particles present on the surface of the toner composition.

11. A toner composition in accordance with claim 2 wherein the rate of charging is less than from about 2 minutes to about 5 minutes when charging is accomplished by the friction contact of toner particles against suitable carrier particles via roll milling.

12. A toner composition in accordance with claim 2 with a negative triboelectric charge of from between about −10 to about −40 microcoulombs per gram.

13. A toner composition in accordance with claim 2 wherein the polymer is comprised of styrene polymers, acrylic or methacrylic polymers, polyesters, or mixtures thereof.

14. A toner composition in accordance with claim 2 wherein the polymer is comprised of styrene acrylates, styrene methacrylates, or styrene butadienes.

15. A toner composition in accordance with claim 2 containing a wax component which has a weight average molecular weight of from about 1,000 to about 7,000.

16. A toner composition in accordance with claim 15 wherein the waxy component is selected from the group consisting of polyethylene and polypropylene.

17. A toner composition in accordance with claim 2 wherein the surface additives are metal salts of a fatty acid, colloidal silicas, or mixtures thereof.

18. A toner composition in accordance with claim 1 wherein the colorant is carbon black, magnetites, or mixtures thereof, cyan, magenta, yellow, red, blue, green, brown pigments, or mixtures thereof.

19. A toner composition in accordance with claim 2 wherein the colorant is carbon black, magnetites, or mixtures thereof, cyan, magenta, yellow, red, blue, green, or brown pigments, and mixtures thereof.

20. A toner composition in accordance with claim 2 wherein the charge additive is selected from the group consisting of phenyl-4-hydroxyphenyl sulfone, tolyl 4-hydroxyphenyl sulfone, phenyl 4-hydroxy-3-tolyl sulfone, 4-hydroxyphenyl-4-hydroxy-3-tolyl sulfone, 4-hydroxyphenyl-3,4-hydroxyphenyl sulfone, 4-hydroxy-3-tolyl-4-hydroxy-3,5-dimethylphenyl sulfone, 4-hydroxy-3-tolyl-4-hydroxy-3,5-dimethylphenyl sulfone, 4-hydroxy-3,5-dimethylphenyl-2-methyl-4,5-dihydroxyphenyl sulfone, 3,4-dihydroxyphenyl-4-hydroxy-3,5-dimethylphenyl sulfone, bis(3,4-dihydroxyphenyl) sulfone, bromophenyl-4-hydroxyphenyl sulfone, chlorophenyl-4-hydroxyphenyl sulfone, and 4-hydroxyphenyl-4,5-dihydroxy-2-tolyl sulfone.

21. A developer composition comprised of the toner composition of claim 1 and carrier particles.

22. A developer composition comprised of the toner composition of claim 2 and carrier particles.

23. A developer composition in accordance with claim 22 wherein the carrier particles are comprised of ferrites, steel, or an iron powder with an optional polymer, or mixtures of polymers, coating thereover.

24. A developer composition in accordance with claim 23 wherein the coating is comprised of a methyl terpolymer, a polyvinylidine fluoride, a polymethyl methacrylate, or a mixture of polymers not in close proximity in the triboelectric series.

25. A process for the preparation of hydroxyaryl sulfone charge enhancing additives by the condensation of sulfuric acid with a hydroxyphenol by the condensation of sulfuric acid with a phenol, followed by condensation with a second phenol, or by the condensation of an aromatic sulfonic acid with a phenol.

* * * * *